US006374874B1

(12) United States Patent
Payne

(10) Patent No.: US 6,374,874 B1
(45) Date of Patent: Apr. 23, 2002

(54) SAND BAG LOADING SYSTEM

(76) Inventor: Robert W. Payne, 5512 60th Way N., St. Petersburg, FL (US) 33709

( * ) Notice: Subject to any disclaimer, the term of this patent is extended or adjusted under 35 U.S.C. 154(b) by 0 days.

(21) Appl. No.: 09/886,229

(22) Filed: Jun. 22, 2001

(51) Int. Cl.[7] ..... B65B 1/04; B65B 3/04; B67C 3/00

(52) U.S. Cl. ..... 141/314; 141/114; 141/313; 141/391; 222/164; 222/166

(58) Field of Search ..... 141/114, 313, 141/314, 319, 391; 222/160, 164, 165, 166

(56) References Cited

U.S. PATENT DOCUMENTS 1,909,670 A * 5/1933 Evans ..... 141/313
4,095,705 A * 6/1978 Hood ..... 214/83.18
6,216,753 B1 * 4/2001 Kanzler et al. ..... 141/313

* cited by examiner

*Primary Examiner*—Timothy L. Maust

(57) ABSTRACT

A sand bag loading system comprises a mounting assembly. The mounting assembly has legs with a connecting member provided there between. The connecting member has first and second ends. A loading tube assembly is provided. The loading tube assembly has a loading tube and a hopper. The loading tube is in a hollow cylindrical configuration with upper and lower sides and first and second ends. The loading tube has an aperture in a rectangular configuration. The hopper is of a rigid metallic material. The hopper has two diverging rectangular sections, coupled to the aperture sides. Two V-shaped sections are coupled to the aperture ends. A bracket hinge assembly is provided. The bracket hinge assembly has upper and lower portions. The upper portion is coupled to the tube. The lower portion is coupled to the connecting member. A pivotal pin is provided between the upper and lower portions.

4 Claims, 3 Drawing Sheets

FIG 3
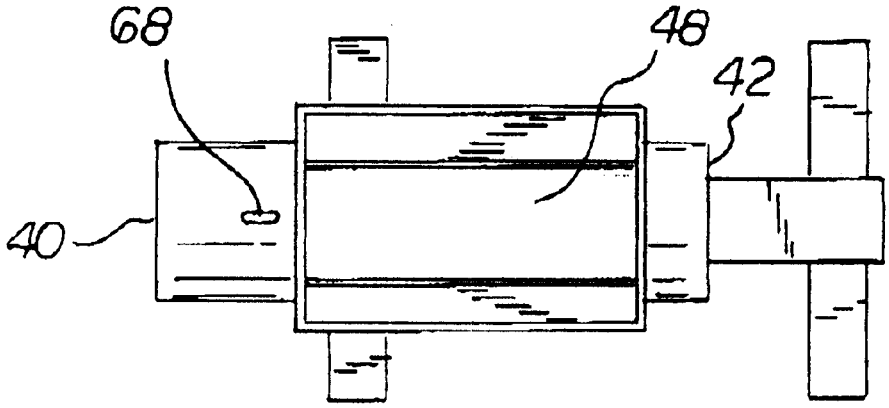
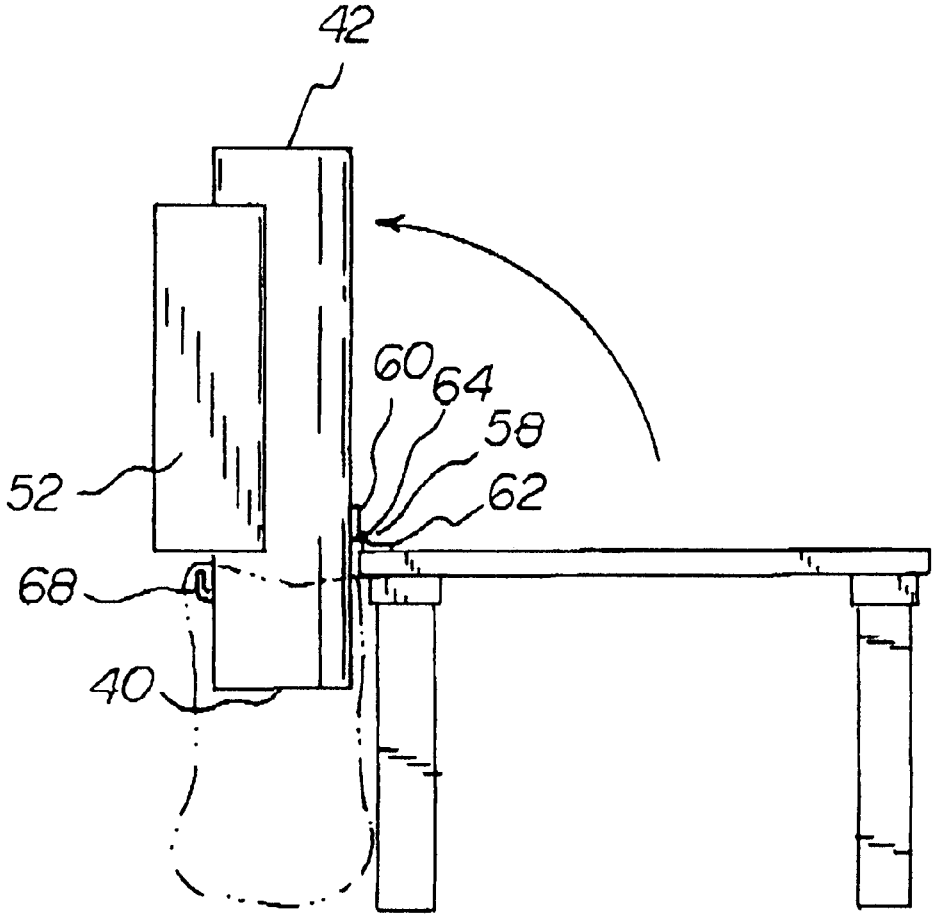
FIG 4

FIG 5
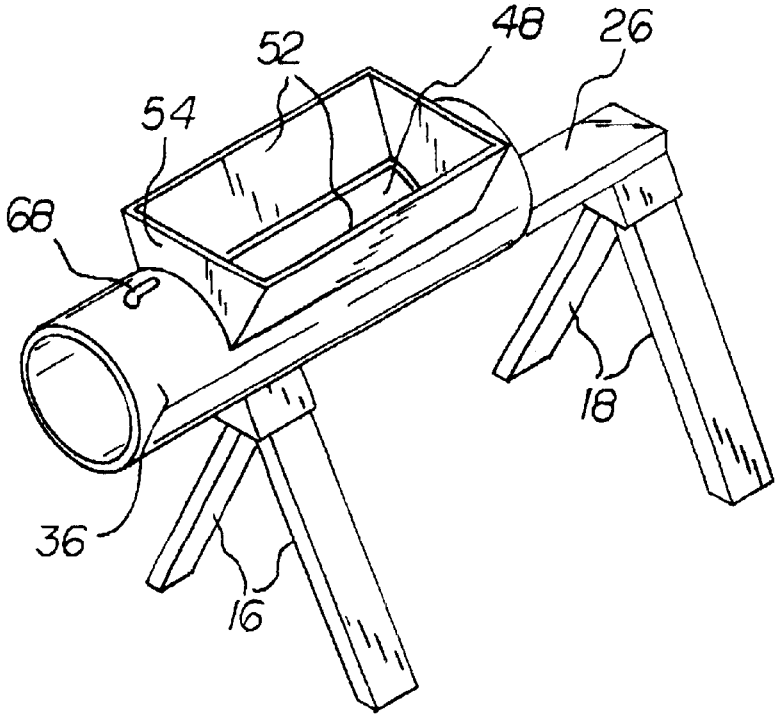
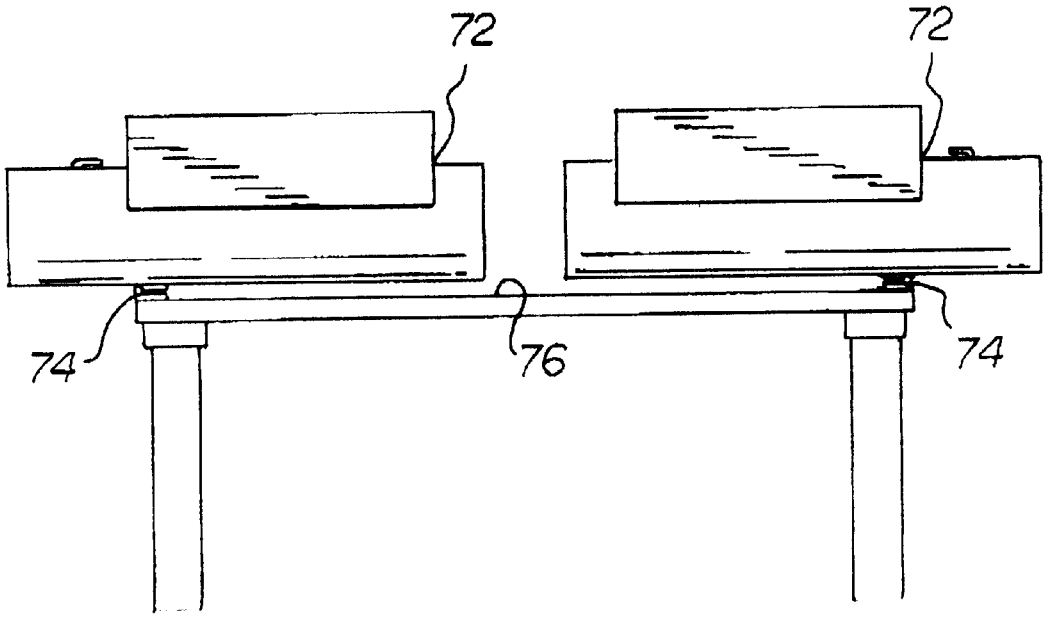
FIG 6

SAND BAG LOADING SYSTEM

BACKGROUND OF THE INVENTION

1. Field of the Invention

The present invention relates to a sand bag loading system and more particularly pertains to allowing a user to fill bags with sand in a safe, efficient and convenient manner.

2. Description of the Prior Art

The use of sand bagging machines of known designs and configurations is known in the prior art. More specifically, sand bagging machines of known designs and configurations previously devised and utilized for the purpose of loading bags with sand by conventional methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. D440,749 to Piner et al discloses a sand bagging device. U.S. Pat. No. 5,425,403 to Herrmann discloses a device to filling bags with a powder-like or granular flowable material, especially sand. U.S. Pat. No. 5,687,781 to Grizz discloses a sand bag filling device. Lastly, U.S. Pat. No. 5,901,762 to Rollins discloses a sand bag filling device.

While these devices fulfill their respective, particular objectives and requirements, the aforementioned patents do not describe a sand bag loading system that allows allowing a user to fill bags with sand in a safe, efficient and convenient manner.

In this respect, the sand bag loading system according to the present invention substantially departs from the conventional concepts and designs of the prior art, and in doing so provides an apparatus primarily developed for the purpose of allowing a user to fill bags with sand in a safe, efficient and convenient manner.

Therefore, it can be appreciated that there exists a continuing need for a new and improved sand bag loading system which can be used for allowing a user to fill bags with sand in a safe, efficient and convenient manner. In this regard, the present invention substantially fulfills this need.

SUMMARY OF THE INVENTION

In view of the foregoing disadvantages inherent in the known types of sand bagging machines of known designs and configurations now present in the prior art, the present invention provides an improved sand bag loading system. As such, the general purpose of the present invention, which will be described subsequently in greater detail, is to provide a new and improved sand bag loading system and method which has all the advantages of the prior art and none of the disadvantages.

To attain this, the present invention essentially comprises a mounting assembly. The mounting assembly is fabricated of a rigid material. The mounting assembly also has two A-framed legs. The mounting assembly further has a connecting member between the two A-framed legs. The connecting member has opposed ends. The opposed ends include a first dispensing end and a remote second end. Both ends are located above the legs. A horizontal surface is provided above the connecting member. A loading tube assembly is provided. The loading tube assembly has a loading tube. The loading tube assembly also has a hopper. The loading tube has a hollow, round cylindrical configuration. The loading tube has an upper side and a lower side.

The loading tube also has a first dispensing end. The first dispensing end extends beyond the dispensing end of the connecting member. The loading tube further includes a second remote end. The second remote end is located above an intermediate extent of the connecting member. The tube is fabricated of a rigid metallic material with an inner surface and an outer surface. A thickness is provided between the inner surface and the outer surface. A hopper aperture is formed in the upper side of the loading tube closer to the remote end than to the dispensing end. The hopper aperture has a generally rectangular configuration. The aperture width to tube diameter ratio is between about 0.66 to 0.75. The aperture length to tube length ratio is between about 0.50 and 0.75. The hopper is formed of a rigid metallic material. Two diverging rectangular sections are coupled to the aperture sides. Two V-shaped sections are coupled to the aperture ends. Next provided is a bracket hinge assembly. The bracket hinge assembly has an upper portion. The upper portion is coupled to the lower side of the tube above the dispensing end of the connecting member. A lower portion is provided. The lower portion is coupled to the connecting member at the dispensing end. A pivotal pin is provided between upper portion and the lower portion. When the tube assembly is loaded with sand through the hopper and aperture the tube assembly may be rotatably moved about the hinge to allow the tipping of the tube from a horizontal loading position to a vertical dispensing position. In this manner, the sand may flow from the tube after being shoveled through the hopper and aperture by a user. Last provided is a flexible bag holder. The flexible bag holder is in a generally inverted L-shaped configuration. The bag holder is coupled to the outside surface of the upper side of the tube. The bag holder is further located near the first dispensing end of the tube. In this manner, the bag holder removably holds a sandbag in place over the dispensing end of the tube while the tube is tipped from the horizontal to the vertical position. The bag holder has a retention force of moderate strength sufficient to retain a loaded sand bag upon the bag holder while the bag is being loaded with sand.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved sand bag loading system which has all of the advantages of the prior art sand bagging machines of known designs and configurations and none of the disadvantages.

It is another object of the present invention to provide a new and improved sand bag loading system which may be easily and efficiently manufactured and marketed.

It is further object of the present invention to provide a new and improved sand bag loading system which is of durable and reliable constructions.

An even further object of the present invention is to provide a new and improved sand bag loading system which is susceptible of a low cost of manufacture with regard to both materials and labor, and which accordingly is then susceptible of low prices of sale to the consuming public, thereby making such sand bag loading system economically available to the buying public.

Even still another object of the present invention is to provide a sand bag loading system for allowing a user to fill bags with sand in a safe, efficient and convenient manner.

Lastly, it is an object of the present invention to provide a new and improved sand bag loading system comprises a mounting assembly. The mounting assembly has legs with a connecting member provided there between. The connecting member has first and second ends. A loading tube assembly is provided. The loading tube assembly has a loading tube and a hopper. The loading tube is in a hollow cylindrical configuration with upper and lower sides and first and second ends. The loading tube has an aperture in a rectangular configuration. The hopper is of a rigid metallic material. The hopper has two diverging rectangular sections, coupled to the aperture sides. Two V-shaped sections are coupled to the aperture ends. A bracket hinge assembly is provided. The bracket hinge assembly has upper and lower portions. The upper portion is coupled to the tube. The lower portion is coupled to the connecting member. A pivotal pin is provided between the upper and lower portions.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a top elevational view taken along line 3—3 of FIG. 1.

FIG. 4 is a side elevational view similar to FIG. 1, but showing an alternate orientation.

FIG. 5 is a perspective view of the system shown in the prior Figures.

FIG. 6 is a side elevational view of the sand bag loading system, but illustrating an alternate embodiment of the invention.

The same reference numerals refer to the same parts throughout the various Figures.

DESCRIPTION OF THE PREFERRED EMBODIMENT

Figure 1:
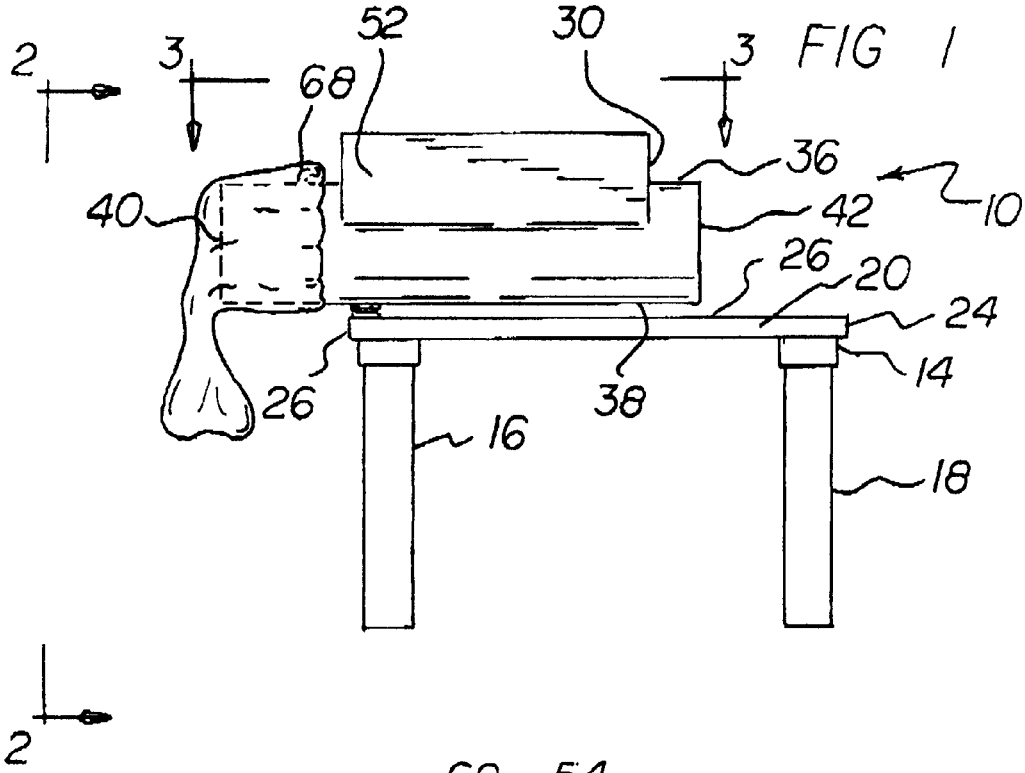
FIG. 1 is a side elevational view of the sand bag loading system.
Figure 2:
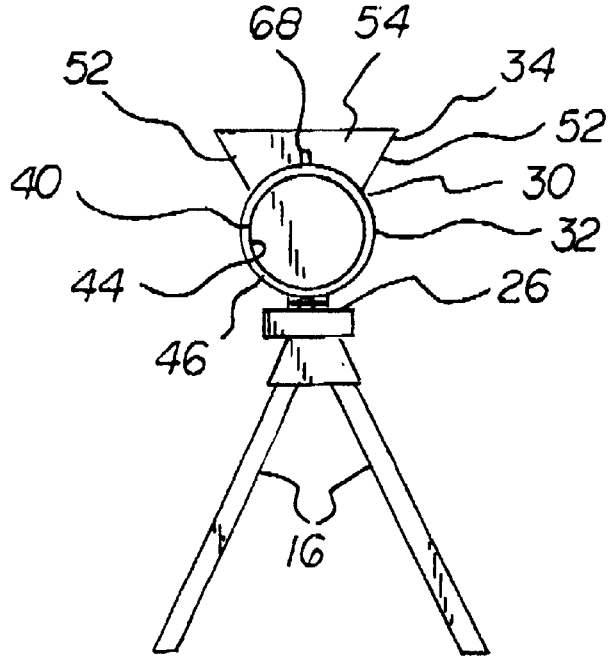
FIG. 2 is a front elevational view taken along line 2—2 of FIG. 1.

With reference now to the drawings, and in particular to FIG. 1 thereof, the preferred embodiment of the new and improved sand bag loading system embodying the principles and concepts of the present invention and generally designated by the reference numeral 10 will be described.

The present invention, the sand bag loading system 10 is comprised of a plurality of components. Such components in their broadest context include a mounting assembly, a loading tube assembly, and a bracket hinge. Such components are individually configured and correlated with respect to each other so as to attain the desired objective.

First provided is a mounting assembly 14. The mounting assembly is fabricated of a rigid material. The mounting assembly also has two A-framed legs 16, 18. The mounting assembly further has a connecting member 20 between the two A-framed legs. The connecting member has opposed ends. The opposed ends include a first dispensing end 22 and a remote second end 24. Both ends are located above the legs. A horizontal surface 26 is provided above the connecting member.

A loading tube assembly 30 is provided. The loading tube assembly has a loading tube 32. The loading tube assembly also has a hopper 34. The loading tube has a hollow, round cylindrical configuration. The loading tube has an upper side 36 and a lower side 38. The loading tube also has a first dispensing end 40. The first dispensing end extends beyond the dispensing end of the connecting member. The loading tube further includes a second remote end 42. The second remote end is located above an intermediate extent of the connecting member. The tube is fabricated of a rigid metallic material with an inner surface 44 and an outer surface 46. A thickness is provided between the inner surface and the outer surface. A hopper aperture 48 is formed in the upper side of the loading tube closer to the remote end than to the dispensing end. The hopper aperture has a generally rectangular configuration. The aperture width to tube diameter ratio is between about 0.66 to 0.75. The aperture length to tube length ratio is between about 0.50 and 0.75. The hopper is formed of a rigid metallic material. Two diverging rectangular sections 52 are coupled to the aperture sides. Two V-shaped sections 54 are coupled to the aperture ends.

Next provided is a bracket hinge assembly 58. The bracket hinge assembly has an upper portion 60. The upper portion is coupled to the lower side of the tube above the dispensing end of the connecting member . A lower portion 62 is provided. The lower portion is coupled to the connecting member at the dispensing end. A pivotal pin 64 is provided between upper portion and the lower portion. When the tube assembly is loaded with sand through the hopper and aperture the tube assembly may be rotatably moved about the hinge to allow the tipping of the tube from a horizontal loading position to a vertical dispensing position. In this manner, the sand may flow from the tube after being shoveled through the hopper and aperture by a user.

Last provided is a flexible bag holder 68. The flexible bag holder is in a generally inverted L-shaped configuration. The bag holder is coupled to the outside surface of the upper side of the tube. The bag holder is further located near the first dispensing end of the tube. In this manner, the bag holder removably holds a sandbag in place over the dispensing end of the tube while the tube is tipped from the horizontal to the vertical position. The bag holder has a retention force of moderate strength sufficient to retain a loaded sand bag upon the bag holder while the bag is being loaded with sand.

In an alternate embodiment of the invention, two loading tube assemblies 72 and two bracket hinge assemblies 74 are provided on an extended connecting member 76. One bracket hinge assembly with an associated loading tube assembly is provided at each end of the connecting member allowing for independent operation.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A sand bag loading system for allowing a user to fill bags with sand in a safe, efficient, and convenient manner, comprising, in combination:

a mounting assembly fabricated of a rigid material having two A-framed legs and a connecting member there between, the connecting member having opposed ends including a first dispensing end and a remote second end, both ends being located above the legs with a horizontal surface on the connecting member there above;

a loading tube assembly having a loading tube and a hopper, the loading tube having a hollow, round cylindrical configuration with an upper side and a lower side and a first dispensing end extending beyond the dispensing end of the connecting member and a second remote end located above an intermediate extent of the connecting member, the tube being fabricated of a rigid metallic material with an inner surface and an outer surface and a thickness there between and with a hopper aperture formed in the upper side of the loading tube closer to the remote end than to the dispensing end and having a generally rectangular configuration, the aperture width to tube diameter ratio being between about 0.66 to 0.75 and the aperture length to tube length ratio being between about 0.50 and 0.75, the hopper formed of a rigid metallic material with two diverging rectangular sections coupled to the aperture sides and two V-shaped sections coupled to the aperture ends;

a bracket hinge assembly having an upper portion coupled to the lower side of the tube above the dispensing end of the connecting member and a lower portion coupled to the connecting member at the dispensing end and a pivotal pin there between, whereby the tube assembly when loaded with sand through the hopper and aperture may be rotatably moved about the hinge to allow the tipping of the tube from a horizontal loading position to a vertical dispensing position whereby the sand may flow from the tube after being shoveled through the hopper and aperture by a user; and a flexible bag holder in a generally inverted L-shaped configuration coupled to the outside surface of the upper side of the tube and located near the first dispensing end of the tube to removably hold a sandbag in place over the dispensing end of the tube while the tube is tipped from the horizontal to the vertical position, with the bag holder having a retention force of moderate strength sufficient to retain a loaded sand bag upon the bag holder while the bag is being loaded with sand.

2. A sand bag loading system comprising:

a mounting assembly having legs and a connecting member there between, the connecting member having a first end and a second end;

a loading tube assembly having a loading tube and a hopper, the loading tube having a hollow cylindrical configuration with an upper side and a lower side and a first end and a second end with an aperture having a generally rectangular configuration, the hopper formed of a rigid metallic material with two diverging rectangular sections coupled to the aperture sides and two V-shaped sections coupled to the aperture ends; and a bracket hinge assembly having an upper portion coupled to the lower side of the tube and a lower portion coupled to the connecting member at the first end and a pivotal pin there between.

3. The system as set forth in claim 2 wherein the second end of the tube is located adjacent to the second end of the connecting member.

4. The system as set forth in claim 2 wherein there are two loading tube assemblies and two bracket hinge assemblies, one at each end of the connecting member for independent operation.

* * * * *